US009891569B2

(12) United States Patent
Konishi

(10) Patent No.: US 9,891,569 B2
(45) Date of Patent: Feb. 13, 2018

(54) IMAGE FORMING SYSTEM CONTROLLING FORMATION OF A PROOF IMAGE

(71) Applicant: KONICA MINOLTA, INC., Chiyoda-ku, Tokyo (JP)

(72) Inventor: Hiroyuki Konishi, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/225,558

(22) Filed: Aug. 1, 2016

(65) Prior Publication Data

US 2017/0068195 A1 Mar. 9, 2017

(30) Foreign Application Priority Data

Sep. 7, 2015 (JP) ..... 2015-175386

(51) Int. Cl.
*G03G 15/00* (2006.01)

(52) U.S. Cl.
CPC ..... *G03G 15/652* (2013.01); *G03G 15/55* (2013.01); *G03G 2215/00569* (2013.01)

(58) Field of Classification Search
CPC ..... G03G 15/5062; G03G 15/55; G03G 15/6517; G03G 15/652; G03G 2215/00569; G03G 2215/00455
USPC ..... 399/15, 82, 384
See application file for complete search history.

(56) References Cited

U.S. PATENT DOCUMENTS

| | | | | |
|---|---|---|---|---|
| 6,856,410 | B1 * | 2/2005 | Hasegawa | H04N 1/3871 358/1.11 |
| 8,675,237 | B2 | 3/2014 | Matsukawa et al. | |
| 2012/0056928 | A1 * | 3/2012 | Powers | B41J 2/2146 347/19 |
| 2012/0206531 | A1 * | 8/2012 | Mizes | G06K 15/027 347/19 |

FOREIGN PATENT DOCUMENTS

| | | | |
|---|---|---|---|
| JP | 2007168165 | A | 7/2007 |
| JP | 2009012294 | A | 1/2009 |
| JP | 2012166438 | A | 9/2012 |
| JP | 2013063543 | A | 4/2013 |
| JP | 2015027028 | A | 2/2015 |

OTHER PUBLICATIONS

Japanese Office Action (and English translation thereof) dated Oct. 31, 2017, issued in counterpart Japanese Application No. 2015-175386.

* cited by examiner

*Primary Examiner* — Sophia S Chen
(74) *Attorney, Agent, or Firm* — Holtz Holtz & Volek PC

(57) ABSTRACT

An image forming system includes: a sheet feeding unit configured to feed continuous paper into an image forming unit; a winding unit configured to wind up the continuous paper; the image forming unit configured to perform image formation on the continuous paper being conveyed from the sheet feeding unit to the winding unit; and a processor configured to perform control to form a proof image in a second job immediately after completion of a first job and put the second job into a standby state, when a setting is (Continued)

made for formation of the proof image for checking a predetermined page in the second job after completion of the first job but before execution of the second job.

17 Claims, 10 Drawing Sheets

IMAGE FORMING SYSTEM CONTROLLING FORMATION OF A PROOF IMAGE

The entire disclosure of Japanese Patent Application No. 2015-175386 filed on Sep. 7, 2015 including description, claims, drawings, and abstract are incorporated herein by reference in its entirety.

BACKGROUND OF THE INVENTION

Field of the Invention

The present invention relates to an image forming system.

Description of the Related Art

There is a known process in which trial image formation called proof printing is performed before an actual job for forming images is executed, and the actual job is executed after a shade and the like are checked. In a case where more than one job is executed, the proof printing for the next job is performed after the previous job is completed, and the next job is executed after a result of the proof printing is checked.

In a case where proof printing is performed in a system that forms images on a continuous paper extending from a sheet feeding roller to a wind-up roller, the proof printing for the next job is performed after the portion of the last image formation (the last page) is conveyed to the wind-up roller at the end of the job. After the image formed in the proof printing is conveyed to a visual check position and is checked, the next job is actually executed. As a result, a large blank (a waste portion) is formed between the last image in the previous job and the image formed by the proof printing, and between the image formed by the proof printing and the first image in the next job.

There is a demand these days for a reduction of such blanks, particularly in a case where relatively expensive paper, such as label roll paper, is used. For example, JP 2015-027028 A discloses a technique for collectively performing proof printing on sets of image data in image formation on continuous paper.

In an image formation process, however, a constant shade is preferably maintained. In view of this, there is a demand for proof printing to be performed immediately before the actual job is executed, but JP 2015-027028 cannot satisfy the demand.

SUMMARY OF THE INVENTION

The present invention has been made in view of the above problems, and an object thereof is to provide an image forming system that can reduce blanks by performing proof printing immediately before executing an actual job.

To achieve the abovementioned object, according to an aspect, an image forming system reflecting one aspect of the present invention comprises:

a sheet feeding unit configured to feed continuous paper into an image forming unit;

a winding unit configured to wind up the continuous paper;

the image forming unit configured to perform image formation on the continuous paper being conveyed from the sheet feeding unit to the winding unit; and a processor configured to perform control to form a proof image in a second job immediately after completion of a first job and put the second job into a standby state, when a setting is made for formation of the proof image for checking a predetermined page in the second job after completion of the first job but before execution of the second job.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First, the configuration of an image forming system according to this embodiment is described.

Figure 1:
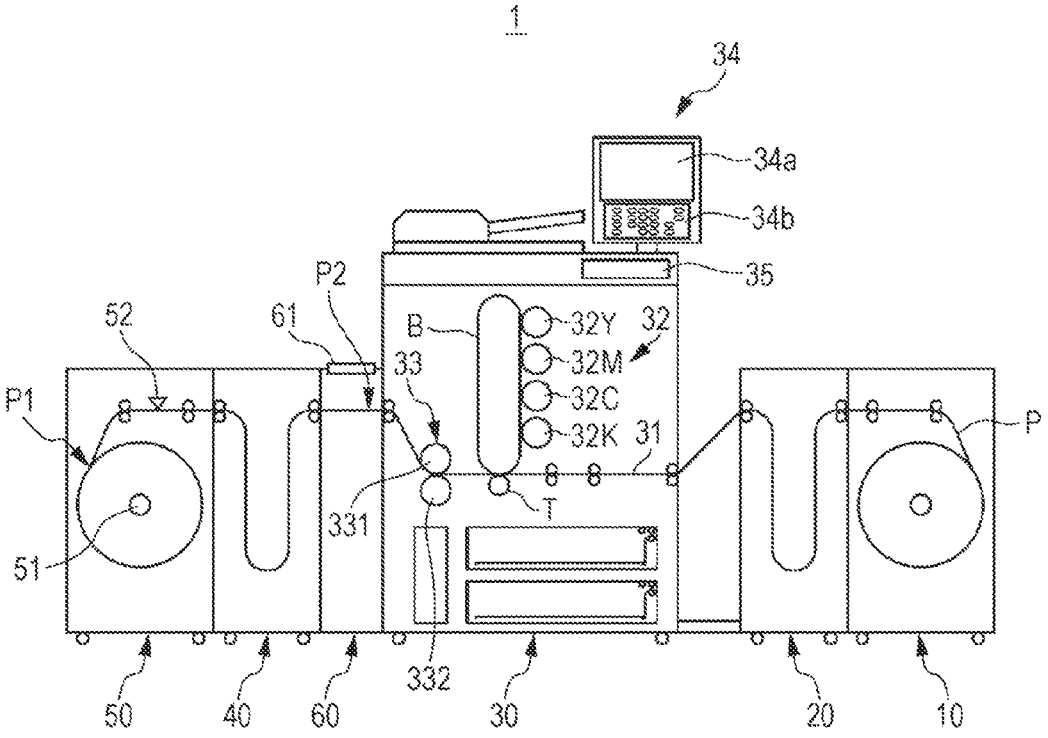
FIG. 1 is a diagram schematically showing an example configuration of an image forming system according to an embodiment of the present invention.

FIG. 1 is a diagram schematically showing an example configuration of an image forming system 1.

The image forming system 1 is a system that uses continuous paper (roll paper) P as a recording medium, and forms an image on this continuous paper P.

As shown in FIG. 1, the image forming system 1 is formed by connecting a sheet feeding device (a sheet feeding unit) 10, a sheet feeding adjusting device 20, an image forming device 30, a winding adjusting device 40, and a winding device (a winding unit) 50 in this order from the upstream side in the direction of conveyance of the continuous paper P. Further, an intermediate device 60 having a checking window (a checking unit) 61 in its upper surface is disposed between the image forming device 30 and the winding adjusting device 40.

The sheet feeding device 10 is a device that feeds continuous paper P into the image forming device 30. In the housing of the sheet feeding device 10, a roll of continuous paper P is wound around a support shaft and is held in a rotatable manner, for example, as shown in FIG. 1. In the sheet feeding device 10, the continuous paper P wound around the support shaft is conveyed to the outside at a constant speed via rollers (such as reeling-out rollers and sheet feeding rollers). Although only one roll of continuous paper P is shown in FIG. 1, rolls of continuous paper might be stored in the sheet feeding device 10.

The sheet feeding adjusting device 20 is disposed on the downstream side of the sheet feeding device 10 and on the upstream side of the image forming device 30 in the direction of conveyance of the continuous paper P. The sheet feeding adjusting device 20 is a device that conveys the continuous paper P from the sheet feeding device 10 to the image forming device 30. To absorb a difference between the speed of conveyance of the continuous paper P in the sheet feeding device 10 and the speed of conveyance of the continuous paper P in the image forming device 30, the sheet feeding adjusting device 20 holds the continuous paper P in a slack state as shown in FIG. 1, and adjusts the feeding of the continuous paper P into the image forming device 30.

The image forming device 30 is a device that has a printing function to form images on the continuous paper P. The image forming device 30 is disposed on the downstream side of the sheet feeding adjusting device 20 and on the upstream side of the winding adjusting device 40 in the direction of conveyance of the continuous paper P.

The winding adjusting device 40 is disposed on the downstream side of the image forming device 30 and on the upstream side of the winding device 50 in the direction of conveyance of the continuous paper P. The winding adjusting device 40 is a device that conveys the continuous paper P from the image forming device 30 to the winding device 50. To absorb a difference between the speed of conveyance of the continuous paper P in the image forming device 30 and the speed of conveyance of the continuous paper P in the winding device 50, the winding adjusting device 40 holds the continuous paper P in a slack state as shown in FIG. 1, and adjusts the discharging of the continuous paper P from the image forming device 30.

The winding device 50 is a device that winds up the continuous paper P conveyed from the image forming device 30 via the winding adjusting device 40. In the housing of the winding device 50, the continuous paper P is wound around a support shaft 51 and is held in the form of a roll, for example, as shown in FIG. 1. More specifically, in the winding device 50, the continuous paper P conveyed from the winding adjusting device 40 is wound around the support shaft 51 at a constant speed via rollers (such as reeling-out rollers and sheet discharging rollers).

In the winding device 50, a cutting unit 52 as a post-processing unit is also provided. The cutting unit 52 includes a laser cutter, for example, and can perform laser cutting on label paper or the like.

In the description below, the position at which an eventual image formed on the continuous paper P in one job is wound around the support shaft 51 will be referred to as the winding completion position P1, as shown in FIG. 1.

The intermediate device 60 is disposed between the image forming device 30 and the winding adjusting device 40.

The continuous paper P conveyed from the image forming device 30 enters the winding adjusting device 40 through the inside of the intermediate device 60. A checking window 61 is formed in the upper surface of the intermediate device 60, and the user can visually check the upper surface of the continuous paper P passing through the inside of the image forming device 30, or the condition of a formed image, through the checking window 61.

In the description below, the position at which an image on the continuous paper P in one job can be visually checked through the checking window 61 will be referred to as the visual check position P2, as shown in FIG. 1.

Next, the structure of the image forming device 30 is described in detail.

Figure 2:
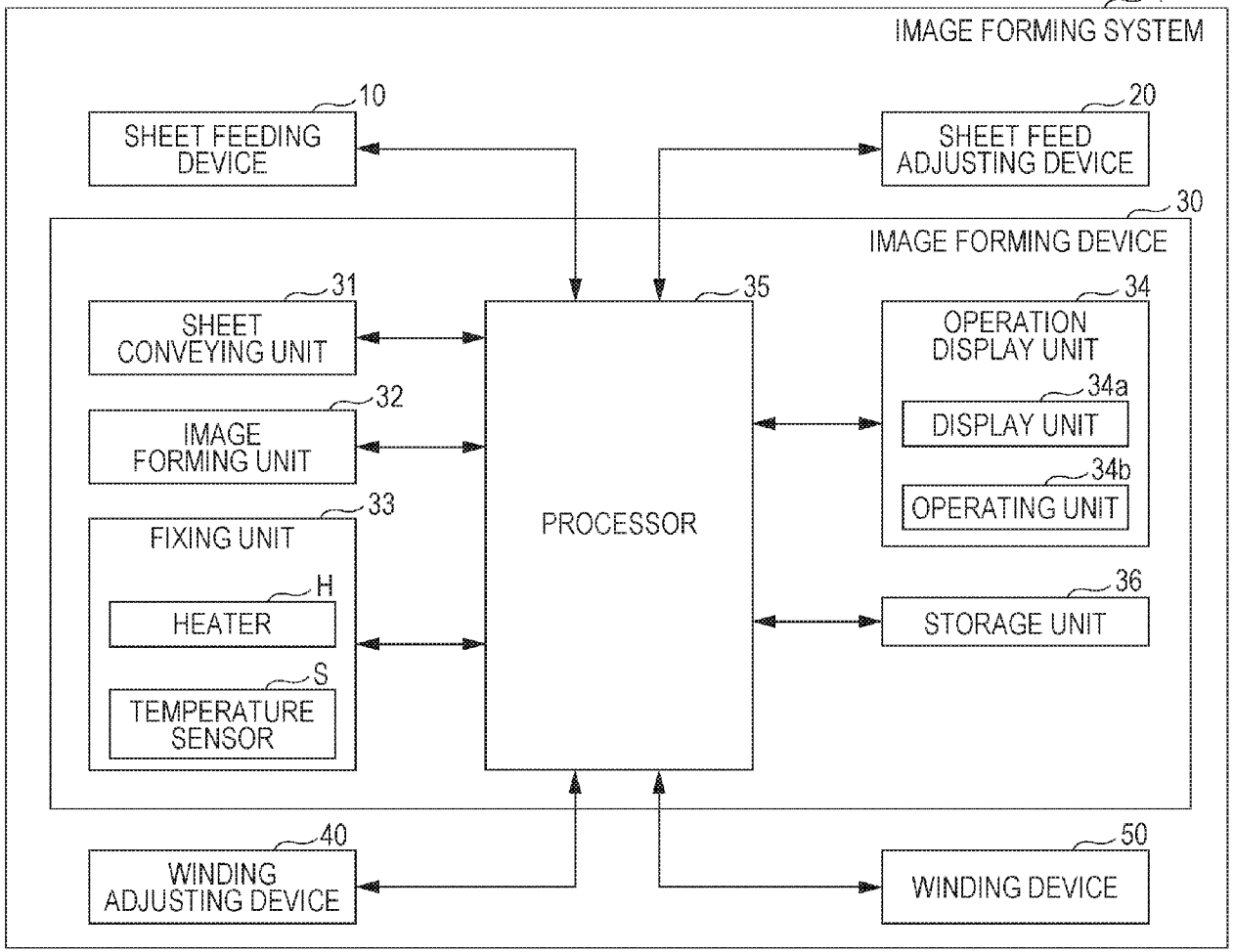
FIG. 2 is a block diagram showing the control structure of an image forming device according to an embodiment of the present invention.

FIG. 2 is a block diagram showing the control structure of the image forming device 30.

As shown in FIG. 2, the image forming device 30 includes a sheet conveying unit 31, an image forming unit 32, a fixing unit 33, an operation display unit 34, a processor 35, and a storage unit 36, for example.

The sheet conveying unit 31 is the mechanism for conveying the continuous paper P in the image forming device 30. For example, using rollers, the sheet conveying unit 31 conveys the continuous paper P from the sheet feeding adjusting device 20 to the image forming unit 32, and further conveys the continuous paper P to the winding adjusting device 40 via the image forming unit 32 and the fixing unit 33.

The image forming unit 32 forms a toner image through an electrophotographic process, and transfers the toner image onto the continuous paper P.

For example, in the image forming unit 32, photosensitive drums 32Y, 32M, 32C, and 32K, and an intermediate transfer belt B, are used as image carriers (see FIG. 1). The intermediate transfer belt B is an endless belt that is wound around rollers and is movably supported by the rollers. Toner images in respective colors formed on the photosensitive drums 32Y, 32M, 32C, and 32K are sequentially transferred onto the intermediate transfer belt B. As the layers of the respective colors overlap on one another, a toner image (a color image) is formed on the intermediate transfer belt B. A bias of the opposite polarity from that of the toner is then applied to a transfer roller 1, so that the toner image formed on the intermediate transfer belt B is transferred onto the continuous paper P.

The fixing unit 33 fixes the toner image transferred onto the continuous paper P.

For example, the fixing unit 33 includes a pair of rollers for nipping the continuous paper P. The pair of rollers are formed with a heating roller 331 and a pressure roller 332 (see FIG. 1).

The heating roller 331 is heated to a predetermined temperature by a heater H serving as a heat source.

The pressure roller 332 is pressed against the heating roller 331 by an elastic member (not shown). The continuous paper P onto which the toner image has been transferred is subjected to heat and pressure, passing through the nip portion between the heating roller 331 and the pressure roller 332. Consequently, the toner image is melted and fixed.

In the vicinity of the outer periphery of the pressure roller 332, a temperature sensor S is disposed. The temperature sensor S can measure the temperature in the vicinity of the outer periphery of the pressure roller 332 as the temperature of the fixing unit 33.

The operation display unit 34 has a display screen. The operation display unit 34 includes a display unit 34*a* that displays various kinds of information on the screen, and an operating unit 34*b* to be used in inputting various commands by the user.

The operation display unit 34 is used as a setting unit in making a setting for formation of a proof image (hereinafter also referred to as proof printing) for checking a predetermined page in a job when a booking is made for the job for performing image formation.

The operation display unit 34 is also used in setting an image interval in the proof printing before the proof printing is performed. Specifically, while an image in the proof printing is formed at the same interval as that in a regular job in accordance with the default setting, a change can be made to the setting. For example, the distance between the position of formation of the last image in one job and the position of formation of the proof image in the next job may be made longer than the distance between the positions of formation of images in the one job. More specifically, a change can be made to the setting by changing the distance between the position of formation of the last image in one job and the position of formation of the proof image in the next job to the same distance as the distance from the winding completion position P1 of the winding unit to the visual check position P2 corresponding to the checking window 61.

The operation display unit 34 is also used as a parameter changing unit in setting parameters related to an image formation process to be performed by the image forming unit 32, such as parameters for designating a shade, a density, and the like.

The processor 35 includes a CPU (Central Processing Unit) and a RAM (Random Access Memory), for example. The CPU of the processor 35 reads various programs, such as a system program and a processing program, from the storage unit 36, and loads the programs into the RAM. In accordance with the loaded programs, the processor 35 performs various kinds of processing.

For example, in a case where a setting for proof printing for a second job is made in successive execution of jobs (a first job and a second job, for example), the processor 35 performs the proof printing for the second job immediately after completion of the first job, and puts the second job into a standby state. In a case where any setting for formation of a proof image in the second job has not been made, the processor 35 executes the second job immediately after completion of the first job.

Such a process (a proof image formation process) will be described later in detail.

The storage unit 36 is formed with a HDD (Hard Disk Drive) or a nonvolatile semiconductor memory, for example.

The storage unit 36 stores the various programs such as the system program and the processing program to be executed by the processor 35, and the data necessary for executing these programs. For example, the storage unit 36 stores the setting information necessary for executing a proof image formation process.

In this embodiment, the processor 35 controls the entire image forming system 1, as shown in FIG. 2. However, the sheet feeding device 10, the sheet feeding adjusting device 20, the winding adjusting device 40, and the winding device 50 may have respective processors of their own.

The image forming device 30 may be an MFP (Multi-Function Peripheral) having a copy function, a scan function, a facsimile function, and the like, in addition to the print function.

Next, operation of the image forming system 1 according to this embodiment is described.

Figure 3:
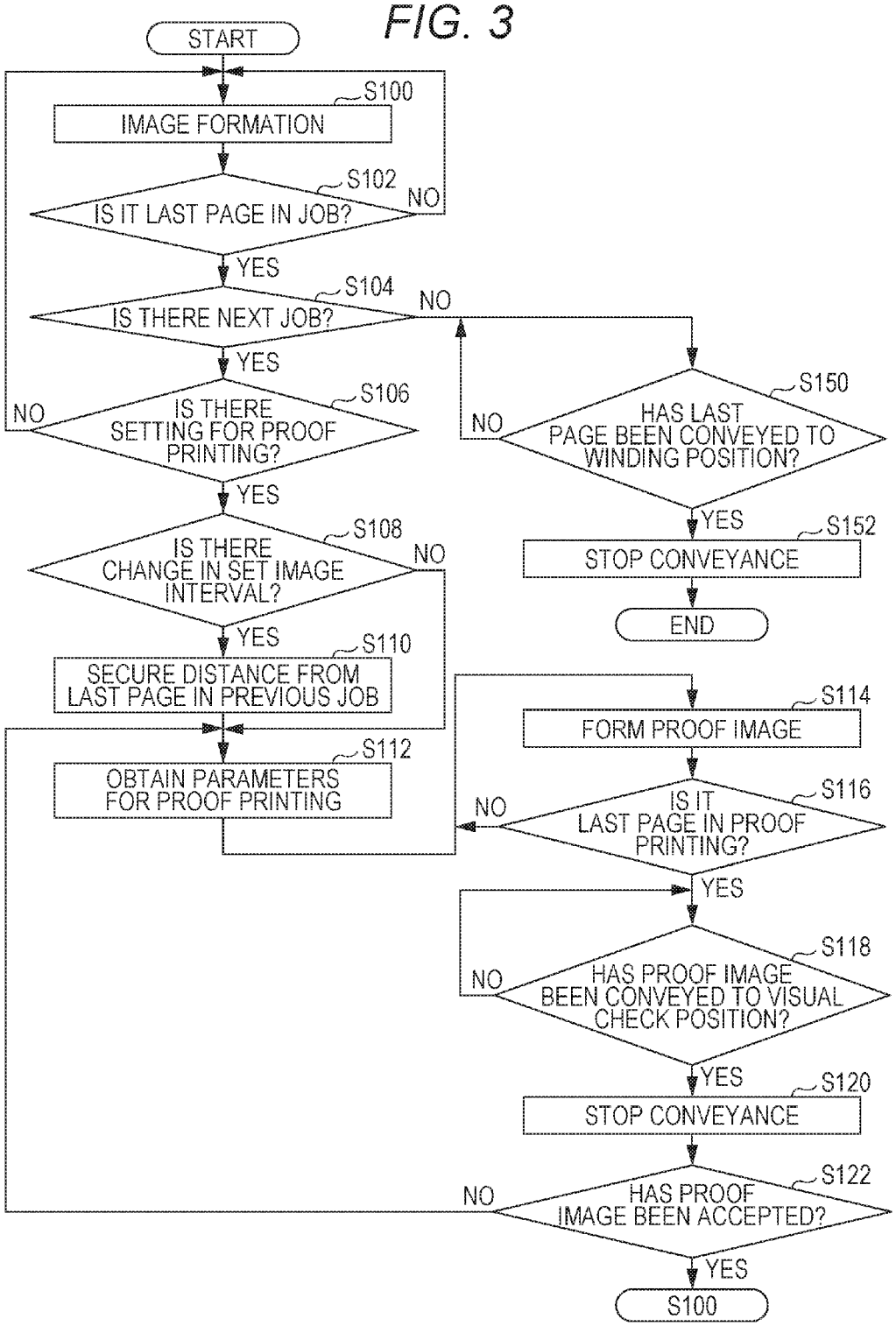
FIG. 3 is a flowchart showing the procedures in a proof image formation process according to an embodiment of the present invention.

FIG. 3 is a flowchart showing the procedures in a proof image formation process.

First, in step S100, as a job starts, the processor 35 performs image formation in the job (first job).

In step S102, the processor 35 determines whether the formation of an image of the last page in the job has been completed. If the image formation has not been completed yet (NO in step S102), the processor 35 returns to step S100 and continues the formation of an image of the next page.

If the formation of an image of the last page in the job has been completed (YES in step S102), on the other hand, the processor 35 moves on to step S104, and determines whether a booking has been made for the next job (second job).

If any booking has not been made for the next job (NO in step S104), the processor 35 moves on to step S150, which will be described later.

If a booking has been made for the next job (YES in step S104), on the other hand, the processor 35 moves on to step S106, and determines whether a setting for proof printing has been made.

If any setting for proof printing has not been made (NO in step S106), the processor 35 moves on to step S100. That is, image formation in the next job is immediately started.

If a setting for proof printing has been made (YES in step S106), on the other hand, the processor 35 moves on to step S108, and determines whether a change is to be made to the set interval between the image of the last page in the job and the image of a page in the proof printing for the next job.

If any change is not to be made to the set image interval (NO in step S108), the processor 35 forms the image in the proof printing at the same interval as the interval in a regular job, and then moves on to step S112, which will be described later.

If a change is to be made to the set image interval (YES in step S108), on the other hand, the processor 35 moves on to step S110, and, in accordance with the setting, secures a distance between the image of the last page in the job and the image of the page in the proof printing for the next job. Since the continuous paper P is being conveyed, counting of time or measurement of distance is started after completion of the formation of the image of the last page in the job. When the time being counted or the distance being measured reaches a predetermined time or a set distance, the processor 35 moves on to step S112. In a case where time is counted, the speed of conveyance is converted into distance.

In step S112, the processor 35 obtains the image (s) for the proof printing and the parameters for forming the image (s). Specifically, the processor 35 obtains one or more pages or sample images to be subjected to the proof printing in the next job. In a case where only one pattern of proof printing is performed, the processor 35 sets the same parameters as the image formation parameters for the next job. In a case where two or more patterns of proof printing are performed, however, the processor 35 sets different parameters. The parameters are designed for designating a shade, a density, and the like.

In step S114, the processor 35 performs proof image formation, using the image (s) and the parameters for the proof printing obtained in step S112.

In step S116, the processor 35 determines whether an image of the last page in the proof printing has been formed.

If an image of the last page in the proof printing has not been formed (NO in step S116), the processor 35 returns to step S114, and repeats the same procedures therefrom.

If an image of the last page in the proof printing has been formed (YES in step S116), on the other hand, the processor 35 moves on to step S118, and determines whether the continuous paper P has been conveyed to the point where the image formed in the proof printing reaches the visual check position P2.

If the image formed in the proof printing has not reached the visual check position P2 (NO in step S116), step S116 is repeated.

If the image formed in the proof printing has reached the visual check position P2 (YES in step S116), on the other hand, the processor 35 moves on to step S120, and stops the conveyance of the continuous paper P.

In step S122, the processor 35 determines whether the image formed in the proof printing has been visually checked by the user, and an OK key for confirmation on the operation panel has been pressed by the user.

If the OK key has been pressed (YES in step S122) the image formed in the proof printing has no problem, and image formation in the next job can be started. Therefore, the processor 35 moves on to step S100 for the next job.

If the OK key has not been pressed (or if a rejection key has been pressed), on the other hand, the processor 35 returns to step S112, and repeats the procedures therefrom.

If it is determined in step S104 that a booking for the next job has not been made (NO in step S104), the processor 35 moves on to step S150, and determines whether the last page in the job has been conveyed to the winding completion position P1. If the last page in the job has not been conveyed to the winding completion position P1 (NO in step S150), the processor 35 repeats the procedure in step S150.

If the last page in the job has been conveyed to the winding completion position P1 (YES in step S150), on the other hand, the processor 35 moves on to step S152, and stops the conveyance of the continuous paper P. The processor 35 then ends this process.

FIGS. 4A through 7 are schematic diagrams for explaining the above described proof image formation process.

FIGS. 4A through 4D show an example case where any change is not made to the set image interval in the proof printing.

Figures 4A, 4B, 4C, 4D:
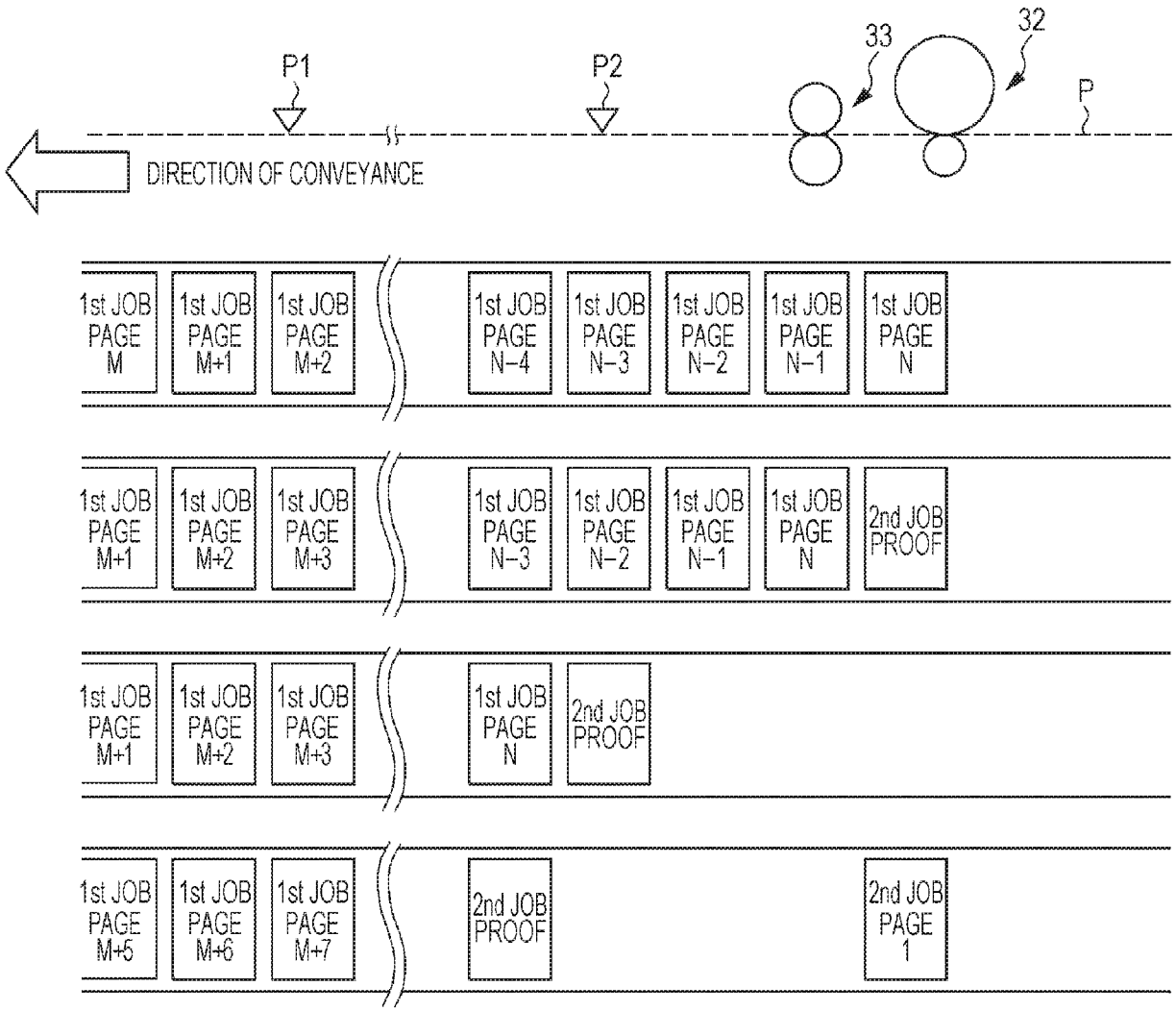
FIGS. 4A through 4D are schematic diagrams for explaining a proof image formation process.

In this case, after an image of the last page in the first job is formed as shown in FIG. 4A, the proof image in the second job is formed at the same interval as the interval between images in the first job as shown in FIG. 4B.

After the proof image in the second job reaches the visual check position P2 as shown in FIG. 40, and the OK key is pressed, an image of the first page in the second job is formed as shown in FIG. 4D.

Figure 5:
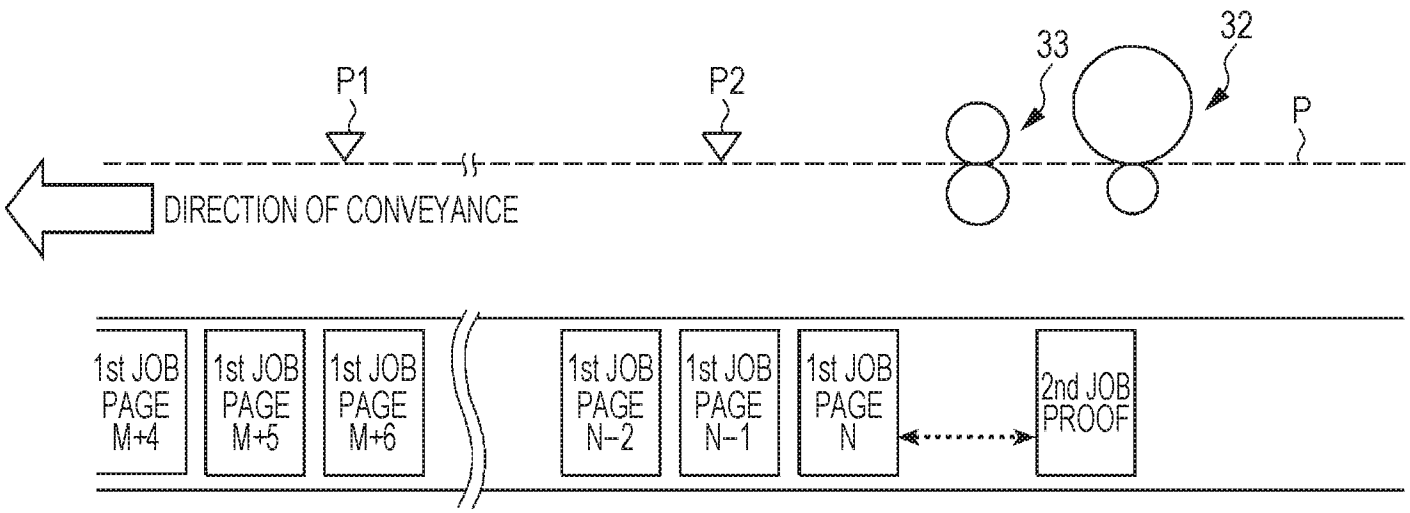
FIG. 5 is a schematic diagram for explaining a proof image formation process.

FIG. 5 shows an example case where a change has been made so that the set image interval becomes longer than the default setting in the proof printing.

In this case, after an image of the last page in the first job is formed as shown in FIG. 5, the proof image in the second job is formed at a longer interval than the interval between images in the first job in accordance with the setting.

After the proof image in the second job reaches the visual check position P2, and the OK key is pressed, an image of the first page in the second job is formed, as in FIGS. 4C and 4D.

As the proof image in the second job is formed at a longer interval than the interval between images in the first job, it becomes easier for the user to cut off the proof image portion later.

Figures 6A, 6B:
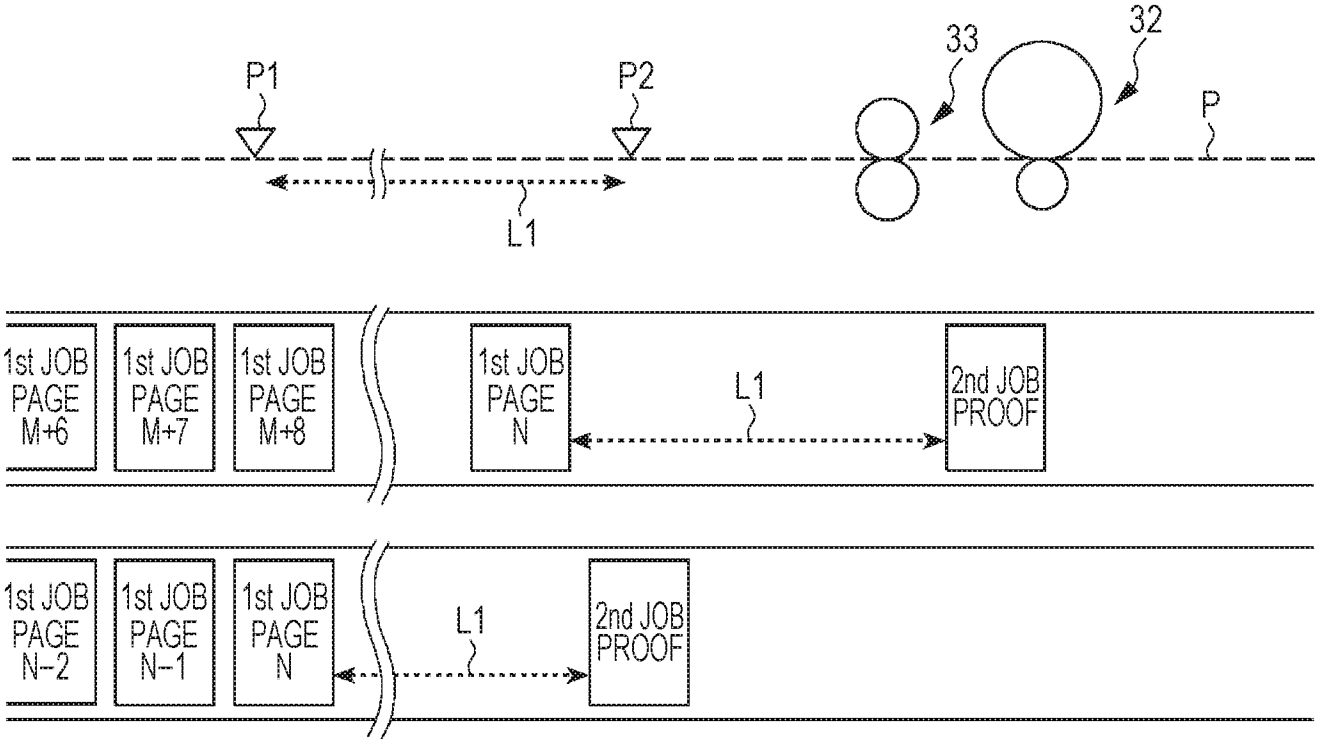
FIGS. 6A and 6B are schematic diagrams for explaining a proof image formation process.

FIGS. 6A and 6B show an example case where the distance from the position of formation of the last image in the first job to the position of formation of the proof image in the second job is the same as the distance from the winding completion position P1 to the visual check position P2.

In this case, after an image of the last page in the first job is formed as shown in FIG. 6A, the proof image in the second job is formed at the interval equivalent to the distance L1 from the winding completion position P1 to the visual check position P2 in accordance with the setting.

When the last page in the first job reaches the winding completion position P1, the proof image in the second job reaches the visual check position P2 at the same time, as shown in FIG. 6B. The conveyance is then stopped.

As the distance from the position of formation of the last image in the first job to the position of formation of the proof image in the second job is the same as the distance from the winding completion position P1 to the visual check position P2, it becomes easier for the user to cut off the proof image portion later, and the trouble of winding up the images of the first job can be avoided.

Figure 7:
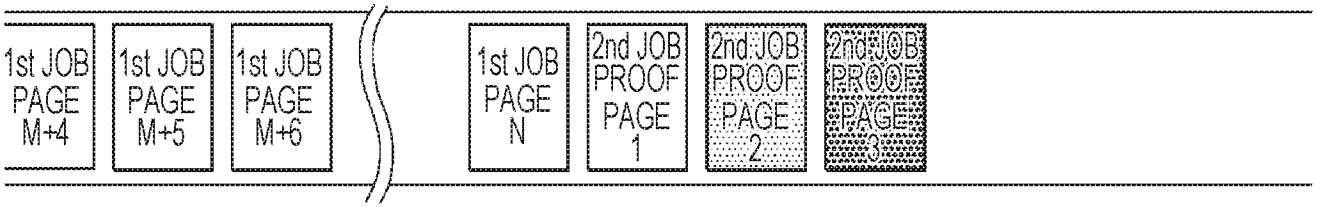
FIG. 7 is a schematic diagram for explaining a proof image formation process.

FIG. 7 shows an example case where different patterns of proof images are formed.

In the example shown in FIG. 7, the proof images have different shades from one another.

Although not shown in the drawing, it is of course possible to make a change to the default setting of the image interval between the last image in the first job and the image of the first page among the different patterns of proof images, as in the examples shown in FIG. 5 and FIGS. 6A and 6B.

As described above, the image forming system 1 according to this embodiment includes: the sheet feeding device 10 that feeds the continuous paper P into the image forming unit 32; the winding device 50 that winds up the continuous paper P; the image forming unit 32 that performs image formation on the continuous paper P being conveyed from the sheet feeding device 10 to the winding device 50; and the processor 35 that performs control so that a proof image in the second job is formed immediately after the first job is completed, and the second job is put into a standby state, if a setting is made for formation of the proof image for checking a predetermined page in the second job after completion of the first job but before execution of the second job.

In a case where the proof image is formed immediately before the actual job is executed, the proof image is formed immediately after the last image in the previous job is formed. Thus, blanks can be reduced.

The image forming system 1 according to this embodiment also includes the operation display unit 34 that makes a setting for formation of the proof image in the second job.

Thus, the user can make a setting for formation of a proof image by operating the operation display unit 34.

According to this embodiment, the processor 35 performs control so that the distance between the position of formation of the last image in the first job and the position of formation of the proof image in the second job becomes longer than the distance between the positions of formation of images in the first job.

Consequently, it becomes easier for the user to cut off the proof image portion of the continuous paper P later.

According to this embodiment, the checking window 61 for checking the continuous paper P is formed between the image forming unit 32 and the winding device 50, and the distance between the position of formation of the last image in the first job and the position of formation of the proof image in the second job is the same as the distance from the winding device 50 to the check window 61.

Consequently, it becomes easier for the user to cut off the proof image portion of the continuous paper P later, and the trouble of winding up the images of the first job can be avoided.

According to this embodiment, the operation display unit 34 can change the parameters related to an image formation process to be performed by the image forming unit 32, and the processor 35 conducts formation of different patterns of proof images with the parameters changed by the operation display unit 34.

Consequently, proof images with different parameters related to an image formation process, such as parameters indicating shades, can be formed and checked.

It should be noted that embodiments of the present invention are not limited to the above described embodiment, and modifications can be made to it without departing from the scope of the invention. The following is a description of modifications.

In a case where different patterns of proof images are formed and checked, a conveyance process for checking the proof printing may be performed, for example.

In such a conveyance process to be performed in a case where different patterns of proof images are formed, the processor 35 performs control so that the continuous paper P is conveyed by a predetermined amount at a time. In this manner, the different patterns of proof images sequentially reach the visual check position P2.

Figure 8:
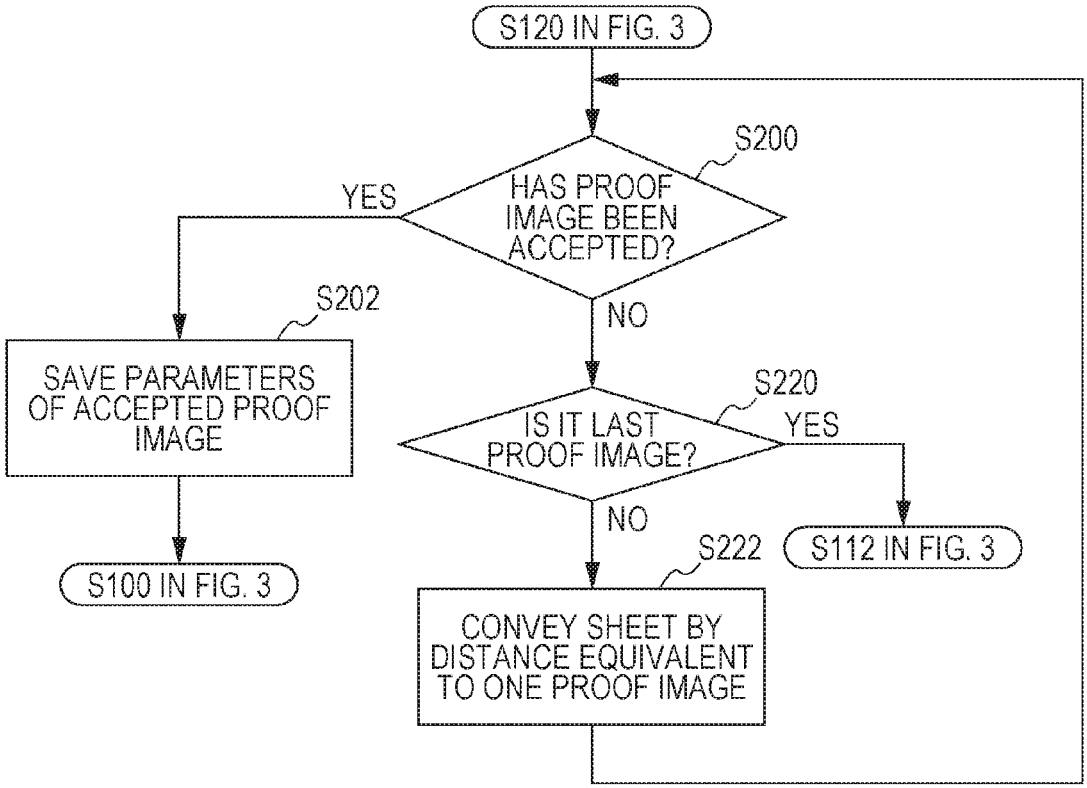
FIG. 8 is a flowchart showing the procedures in a modification of a proof image formation process.

FIG. 8 is a flowchart showing the conveyance process for checking the proof printing.

This process is the same as the process shown in FIG. 3, except for the procedures after step S120. Therefore, FIG. 8 does not show the procedures before step S120.

First, in step S120, the processor 35 stops the conveyance of the continuous paper P.

In step S200, the processor 35 determines whether an image formed in the proof printing has been visually checked by the user, and the OK key for confirmation on the operation panel has been pressed by the user.

If the OK key has been pressed (YES in step S200), the image formed in the proof printing has no problem, and image formation in the next job can be started. Therefore, the processor 35 moves on to step S202, and saves the parameters of the accepted proof image. The processor 35 then moves on to step S100 in FIG. 3 for the next job. The parameters saved in step S202 are used in the image formation in the next job.

If the OK key has not been pressed (or the rejection key has been pressed) (NO in step S200), the processor 35 moves on to step S220, and determines whether the proof image is of the last page.

If the proof image is of the last page (YES in step S220), the next proof image does not exist (or if all the proof images are rejected), the processor 35 returns to step S112 in FIG. 3, to re-set the parameters and again perform the proof printing.

If the proof image is not of the last page (NO in step S220), the processor 35 moves on to step S222, and conveys the continuous paper P by the distance (the predetermined amount) equivalent to one proof image, to check the next proof image. The conveyance distance can be changed in accordance with the position and the size of the checking window 61, the size of the proof image, or the like.

Figures 9A, 9B:
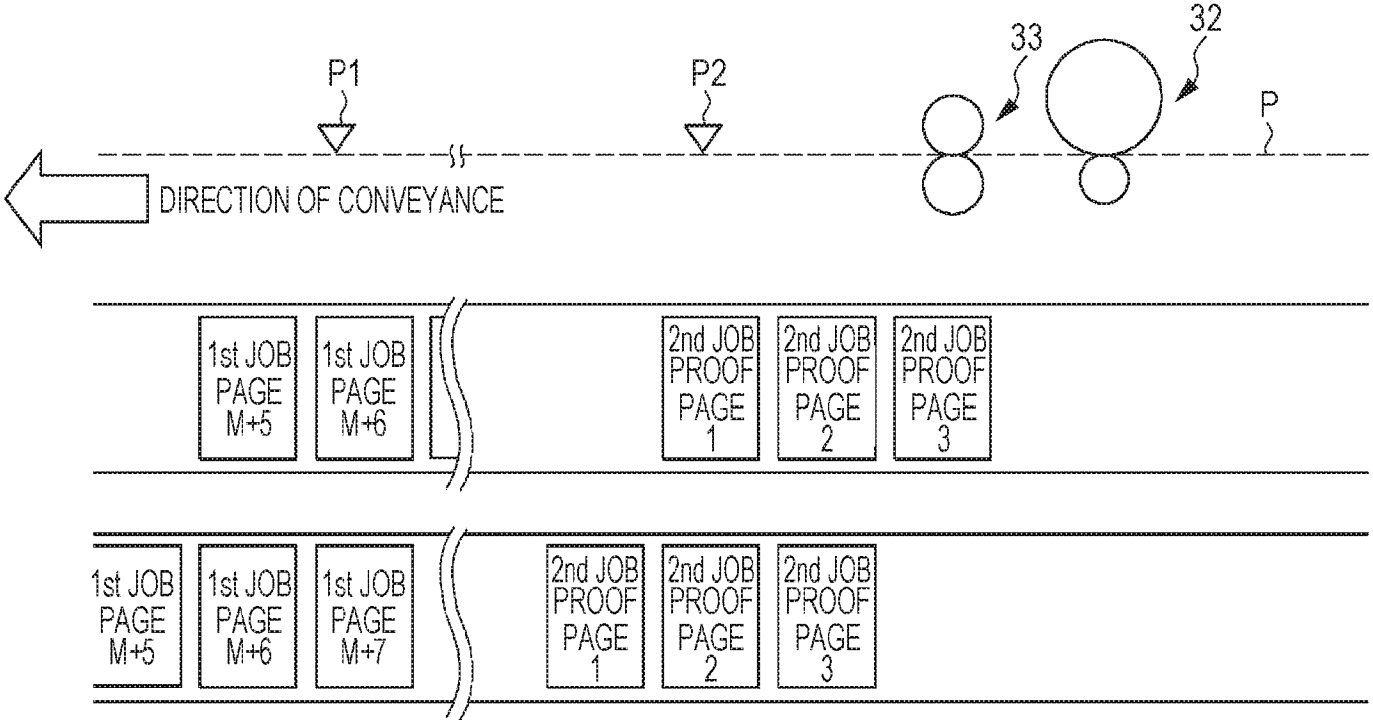
FIGS. 9A and 9B are schematic diagrams for explaining a modification of a proof image formation process.

FIGS. 9A and 9B show an example of a conveyance process in which conveying and stopping are alternately performed to check different patterns of proof images.

In this case, when the first page of the proof images in the second job reaches the visual check position P2 as shown in FIG. 9A, the conveyance is temporarily stopped.

If the rejection key is pressed, the conveyance is resumed. When the second page of the proof images in the second job reaches the visual check position P2 as shown in FIG. 9B, the conveyance is again stopped.

In a case where different patterns of proof images are formed as described above, the conveyance of the continuous paper P is stopped in such a manner that each proof image is stopped at the visual check position P2 once. Thus, all the proof images can be checked without fail.

Alternatively, the processor 35 may control the image forming unit 32 to form an image of a mark for post-processing during job execution, but not to form any image of the mark during proof image formation.

Figure 10:
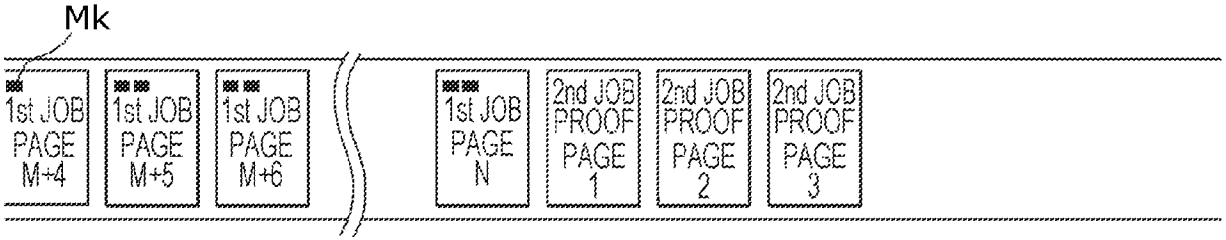
FIG. 10 is a schematic diagram for explaining a modification of a proof image formation process.

FIG. 10 shows an example case where an image of a mark Mk for post-processing is formed during job execution, but any image of the mark Mk is not formed in proof images.

The post-processing may be the laser cutting to be performed by the cutting unit 52. The processor 35 determines whether the mark Mk exists in each image, and then conducts the laser cutting.

In the above described embodiment, the visual check position is located between the image forming device 30 and the winding adjusting device 40, and the visual checking window 61 is formed in the intermediate device 60. However, a scanner, a monitor, a camera, or the like may be used as a checking unit, instead of the checking window 61.

In the above described embodiment, a setting for proof printing is made through the operation display unit 34. However, a setting for proof printing may be included in job information, for example.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming system comprising:

a sheet feeding unit configured to feed continuous paper into an image forming unit;

a winding unit configured to wind up the continuous paper;

the image forming unit, which is configured to perform image formation on the continuous paper being conveyed from the sheet feeding unit to the winding unit; and a processor configured to perform control to form a proof image of a predetermined page in a second job immediately after completion of a first job and to put the second job into a standby state, when a setting is made for formation of the proof image, wherein the proof image is an image for checking the predetermined page in the second job, and the processor performs the control after completion of the first job but before execution of the second job.

2. The image forming system according to claim 1, further comprising a setting unit configured to make the setting for the formation of the proof image.

3. The image forming system according to claim 1, further comprising a post-processing unit configured to perform post-processing on the continuous paper subjected to the image formation performed by the image forming unit, wherein the processor controls the image forming unit to form an image of a mark for the post-processing during job execution and not to form an image of the mark during proof image formation.

4. The image forming system according to claim 1, wherein the processor makes a distance between a position of formation of the last image in the first job and a position of the formation of the proof image longer than a distance between positions of formation of images in the first job.

5. The image forming system according to claim 4, further comprising a checking unit to be used for checking the continuous paper, the checking unit being formed between the image forming unit and the winding unit, wherein the distance between the position of the formation of the last image in the first job and the position of the formation of the proof image is equal to a distance from the winding unit to the checking unit.

6. The image forming system according to claim 1, further comprising a parameter changing unit configured to change a parameter related to an image formation process to be performed by the image forming unit, wherein the processor conducts formation of a plurality of patterns of proof images with the parameter changed by the parameter changing unit.

7. The image forming system according to claim 6, further comprising a checking unit to be used for checking the continuous paper, the checking unit being formed between the image forming unit and the winding unit, wherein, when a plurality of patterns of proof images are formed, the processor conveys the continuous paper by a predetermined amount at a time, to stop the plurality of patterns of proof images at the checking unit one by one.

8. The image forming system according to claim 2, wherein, when the setting unit has not made the setting for the formation of the proof image, the processor executes the second job immediately after completion of the first job.

9. An image forming method implemented in an image forming system including a sheet feeding unit configured to feed continuous paper into an image forming unit, a winding unit configured to wind up the continuous paper, and the image forming unit, which is configured to perform image formation on the continuous paper being conveyed from the sheet feeding unit to the winding unit, the image forming method comprising:

performing control to form a proof image of a predetermined page in a second job immediately after completion of a first job and to put the second job into a standby state, when a setting is made for formation of the proof image, wherein the proof image is an image for checking the predetermined page in the second job, and the control to form the proof image is performed after completion of the first job but before execution of the second job.

10. The image forming method according to claim 9, wherein the image forming system further includes a setting unit configured to make the setting for the formation of the proof image.

11. The image forming method according to claim 10, further comprising a step of executing the second job immediately after completion of the first job, when the setting unit has not made the setting for the formation of the proof image.

12. The image forming method according to claim 9, further comprising making a distance between a position of formation of the last image in the first job and a position of the formation of the proof image longer than a distance between positions of formation of images in the first job.

13. The image forming method according to claim 12, wherein the image forming system further includes a checking unit to be used for checking the continuous paper, the checking unit being formed between the image forming unit and the winding unit, and wherein the distance between the position of the formation of the last image in the first job and the position of formation of the proof image is equal to a distance from the winding unit to the checking unit.

14. The image forming method according to claim 9, wherein the image forming system further includes a parameter changing unit configured to change a parameter related to an image formation process to be performed by the image forming unit, and wherein the image forming method further comprises conducting formation of a plurality of patterns of proof images with the parameter changed by the parameter changing unit.

15. The image forming method according to claim 14, wherein the image forming system further includes a checking unit to be used for checking the continuous paper, the checking unit being formed between the image forming unit and the winding unit, and wherein, when a plurality of patterns of proof images are formed, the image forming method further comprises a step of conveying the continuous paper by a predetermined amount at a time, to stop the plurality of patterns of proof images at the checking unit one by one.

16. The image forming method according to claim 9, wherein the image forming system further includes a post-processing unit configured to perform post-processing on the continuous paper subjected to the image formation performed by the image forming unit, and wherein the image forming method further comprises a step of controlling the image forming unit to form an image of a mark for the post-processing during job execution and not to form an image of the mark during proof image formation.

17. An image forming system comprising:

a sheet feeding unit configured to feed continuous paper into an image forming unit;

a winding unit configured to wind up the continuous paper;

the image forming unit, which is configured to perform image formation on the continuous paper being conveyed from the sheet feeding unit to the winding unit;

a parameter changing unit configured to change a parameter related to an image formation process to be performed by the image forming unit;

a checking unit to be used for checking the continuous paper, the checking unit being formed between the image forming unit and the winding unit; and a processor configured to perform control to form a proof image in a second job immediately after completion of a first job and put the second job into a standby state, when a setting is made for formation of the proof image for checking a predetermined page in the second job after completion of the first job but before execution of the second job, wherein the processor conducts formation of a plurality of patterns of proof images with the parameter changed by the parameter changing unit, and wherein, when a plurality of patterns of proof images are formed, the processor conveys the continuous paper by a predetermined amount at a time, to stop the plurality of patterns of proof images at the checking unit one by one.

* * * * *